United States Patent [19]

Eaton

[11] 3,954,173

[45] May 4, 1976

[54] PACKAGE FOR SENSITIVE PLATES

[75] Inventor: William E. Eaton, Tequesto, Fla.

[73] Assignee: Basic Microelectronics, Inc., Lake Park, Fla.

[22] Filed: July 2, 1973

[21] Appl. No.: 375,450

[52] U.S. Cl. ..... 206/205; 206/455; 206/471; 229/3.5 MF

[51] Int. Cl.[2] ..... B65D 81/24; B65D 85/48

[58] Field of Search ..... 206/72, 205, 316, 449, 206/450, 455, 456, 471, 84, 454; 229/3.5 MF

[56] References Cited

UNITED STATES PATENTS

| | | | |
|---|---|---|---|
| 1,857,126 | 5/1932 | Doring et al. | 206/205 |
| 2,129,447 | 9/1938 | Schuler | 206/316 |
| 2,878,128 | 3/1959 | Jorgenson | 229/3.5 MF |
| 2,950,004 | 8/1960 | Acomb | 206/471 |
| 3,119,492 | 1/1964 | Burket | 206/455 |
| 3,197,026 | 7/1965 | Gabryel | 206/471 |
| 3,229,886 | 1/1966 | Grogel | 229/3.5 MF |
| 3,489,265 | 1/1970 | Puente | 206/316 |
| 3,710,975 | 1/1973 | Jansen | 206/456 |
| 3,752,387 | 8/1973 | Arfert | 229/3.5 MF |

FOREIGN PATENTS OR APPLICATIONS

| | | | |
|---|---|---|---|
| 597,991 | 5/1960 | Canada | 206/456 |
| 1,093,869 | 12/1967 | United Kingdom | 206/456 |

*Primary Examiner*—William I. Price
*Assistant Examiner*—Allan N. Shoap
*Attorney, Agent, or Firm*—Malin & Haley

[57] ABSTRACT

A shipping, storage tray for protecting the surface integrity of a sensitive brittle plate, such as glass, placed therein. The sensitive plate is cushioned along its lower peripheral edge on ridge and groove shaped side walls of a ductile, conformable support tray which prevent surface contact of the plate and the tray bottom. The edges of the tray are folded back and beneath the tray exterior to prevent flakes from the raw sheared edges from being deposited inside the tray and on the plate surface. A chemical coating to enhance wetability of subsequent photo-sensitive coatings on the plate surface is deposited in the try bottom.

3 Claims, 6 Drawing Figures

PACKAGE FOR SENSITIVE PLATES

BACKGROUND OF THE INVENTION

1. Field of the Invention

This invention relates generally to a packaging tray for shipping sensitive glass plates which have extremely low tolerances for receiving impurities on the plate surface. The plate is to be utilized as a microoptic device; therefore, one side of the plate surface must be kept as free from impurities as possible.

2. Description of the Prior Art

Several packaging devices have been shown in the prior art constructed of plastic materials for use in protecting photographic slides and the like which have been unacceptable for shipping impurity sensitive plates due to vapor transmission and the vapor pressure of the plastic material which deposits impurities from the package itself onto the surface of the sensitive plate. Metal packages have been shown in the prior art but are unacceptable since any dimensional variation between the glass plate and the package caused relative movement in the package during shipping and handling, producing quantities of microscopic particles on the sensitive plate. Also particles from the raw cut peripheral edges of the metal package were deposited on the sensitive plate during handling, wrapping and unwrapping of the plate. Applicant's invention overcomes these problems by providing a sufficiently ductile but non-resilient package having a ridge and groove shaped sidewall structure for supporting and retaining a sensitive plate, each wall edge being folded back to prevent microscopic flakes along the cut edge of the sidewall from being received within the tray itself. The ductile material and sidewall contour minimize plate edge chipping along the contacting peripheral plate edge. Plate-tray relative movement is minimized by pressing the ductile package wall and the plate edge together embedding the plate edge in the package wall. The folded sidewall also increases the structural integrity of the package. Additionally the use of aluminum foil to cover and seal the package prevents further flaking and allows a chemical to be deposited and sealed within the package itself to enhance the wetability of subsequent photo-sensitive coating on the plate surface.

SUMMARY OF THE INVENTION

A metal package, for protecting the surface integrity of a sensitive brittle plate placed therein, comprising a ductile metal supporting tray having sidewalls and a bottom, said sidewalls being angularly disposed relative to the horizontal, each wall having a ridge and groove plate support portion to receive the lower peripheral edge of said sensitive plate, thereby preventing contact of said plate surface at the bottom upper face of said tray, said tray sidewalls having cut edges being folded back on the outside of said tray, a foil covering sealably coupled to said sidewall edges on the outside forming a sealed package, the ductile tray material allowing the four tray sidewalls to be squeezed between the thumb and fingers to embed the plate edges in the material, thus firmly holding the plate in the tray to prevent plate-tray relative movement, and a chemical deposited within said package and sealed therein to enhance the wetability of the sensitive plate surface for subsequent photo-sensitive coating. A plurality of the packaged plates are disposed in an atmosphere evacuated container for shipment. The environment vaporizes the chemical in the package whereby the plates are coated.

It is an object of this invention to provide an improved shipping tray for protecting a sensitive plate.

It is another object of this invention to provide a shipping tray of a ductile metal material which reduces the impurities within the storage tray to provide a more particle and contamination free environment for a plate shipped therein.

And still yet another object of this invention is to provide a storage tray for a sensitive plate which provides a firm mounting and a sealed environment for protecting said plate.

And still yet another object of this invention is to provide a storage and shipping container for a glass plate of reduced complexity and cost while maintaining structural integrity and reducing impurities in the container regardless of the tolerance differences and irregularities in the peripheral dimensions of the glass plate relative to the package inner dimensions.

In accordance with these and other objects which will be apparent hereinafter, the instant invention will now be described with particular reference to the accompanying drawings.

PREFERRED EMBODIMENT OF THE INVENTION

Figure 1:
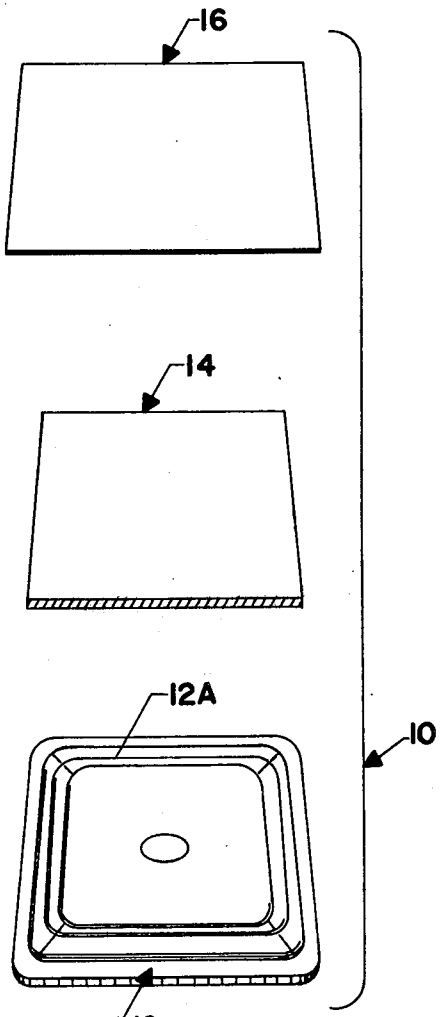
FIG. 1 shows an exploded view of Applicant's invention in perspective including the storage tray, the sensitive plate to be placed therein, and a foil wrapping top.

Referring now to the drawings and especially FIG. 1, Applicant's packaging device is shown generally at 10 including a storage tray 12 which receives a sensitive plate 14, the entire packaging being sealed by a top aluminum foil cover 16 which is placed on top and folded around the sidewalls of the storage tray 12 to its underside, the edges being squeezed between the thumb and forefingers.

Figure 2:
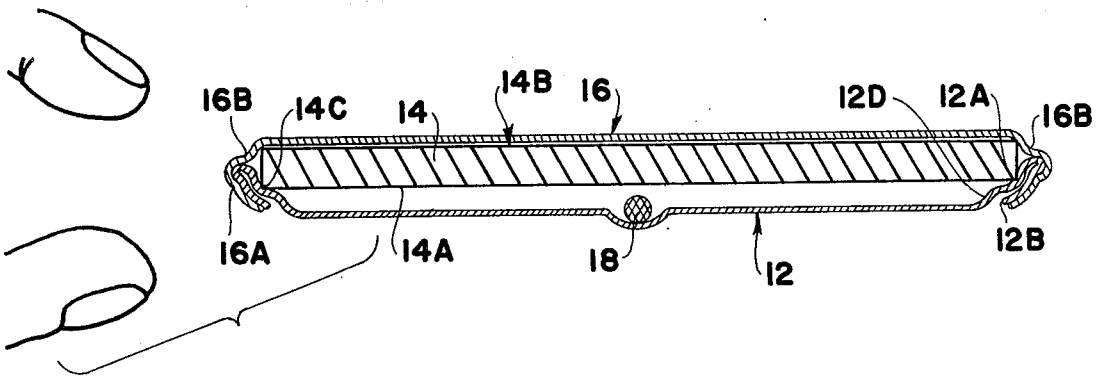
FIG. 2 shows a cross-sectional elevation of Applicant's invention including a sensitive plate stored therein.

FIG. 2 shows the sensitive plate 14 packaged and housed within Applicant's invention, plate 14 having a sensitive surface 14A disposed downwardly and engaged around its lower peripheral edges 14C with the tray 12 sidewalls, with each sidewall contoured in a ridge 12D and groove 12A fashion to engage just the lower edge of the plate. The tray wall structure continues so that the outer edges are folded back beneath the exterior tray walls and bottom, the tray edges being shown as 12B forming a double support wall on each side. This prevents any unevenly cut edges from flaking which would introduce impurities into the package environment. The inside bottom surface has a recessed portion which may receive a chemical substance 18 which will cause a light beneficial film to be deposited on the sensitive surface 14A to enhance the wetability of the plate surface for subsequent photo-sensitive coatings on the plate.

To cover the tray, aluminum foil 16 is wrapped and pressed about the outside wall edges of the tray, with overlapped portions 16A and 16B forming a seal around the entire tray.

The supporting tray sidewall and bottom structure 12A and 12D of tray 12 is unitary and contoured in a ridge and groove fashion so that the tray inner surface that contacts the plate is approximately at a 45° angle and falls away so that the plate is supported along its edge within the cavity of casing 12 without any engagement of the surface area 14A against the inside surface of the tray 12.

Figure 3:
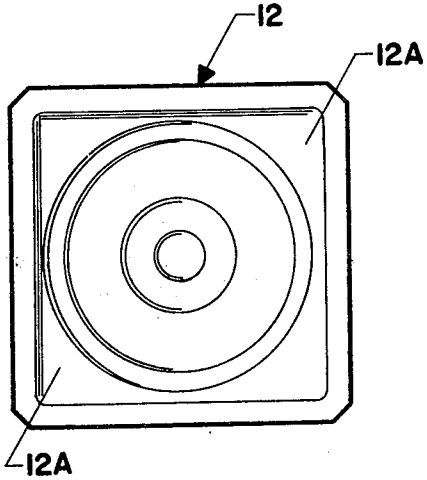
FIG. 3 shows a top plan view of the storage tray utilized in Applicant's invention.

FIG. 3 shows the tray 12 and the shaped sidewall structure having a contoured sidewall with groove 12A and ridges 12D which fall away toward the center of the tray to allow the proper engagement of the plate and the sidewall. Additional contour may be added to the center base area for allowing the package to rest on a table or the like.

Figure 4:
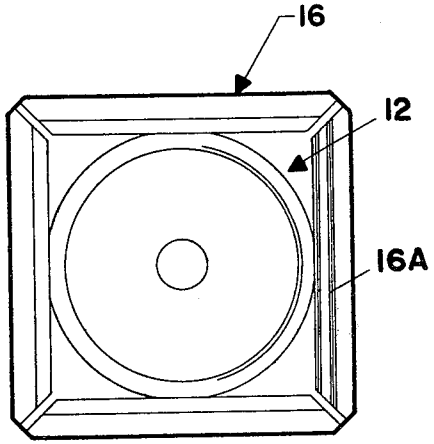
FIG. 4 shows a bottom plan view of Applicant's invention.

FIG. 4 shows the outside bottom of Applicant's package with the tray 12 having a foil 16 wrapped over it with overlapping edge portion 16A. The corners of the device may be rounded to provide proper form fitting of the foil in the bottom area. The foil is wrapped with two opposite sides being folded parallely and engaged with the bottom of the tray with the opposite parallel sides having the edge flaps 16A folded over them. The tray sidewalls and the plate edges are then squeezed together, preferably between the thumb and forefingers, embedding the lower plate edge 14C into the tray material.

Referring back to FIG. 3, the proper contour of the tray inside bottom is shown which descends from the outer folded edge inwardly toward the tray groove 12A providing an inclined surface approximately at a 45° angle to the horizontal which then descends sharply in the direction of the tray center and then levels out along the bottom center portion of the tray. In the cross-sectional view (FIG. 2), the contour is in a ridge and groove shape, with the groove portion 12A being somewhat angled relative to the horizontal at approximately 45 degrees. This contour allows for dimensional variations in the glass plate to fit without platetray relative movement and increases the structural rigidity and the supporting strength of the tray for retaining the surface plate which is embedded along its lower peripheral edge in the groove portion of the device. Further strength is achieved by the folded edges of the tray being contoured and extending flush against the sidewall along the ridge and groove contour on the outside of the device. Top foil contour (16B) and plate edges and tray engagement prevent movement which otherwise would generate particles during handling and shipping.

The selection of material for the tray is very important. It must be constructed of a ductile yet somewhat non-resilient material, such as annealed pure aluminum. The ductility or malleability of the material insures that the contact between the sensitive plate edge and the tray inside wall firmly retains the plate within the tray preventing relative plate tray motion without damaging the plate or introducing microscopic particles into the tray from edge flaking. Additional structural contours may be added in the center base area of the tray in a hill and valley fashion to increase the rigidity of the structure. Other metals of comparable and malleability may be selected; however, soft aluminum is chosen in the preferred embodiment because it is noncorrosive, lightweight, ductile and inexpensive.

In operation, the sensitive plate is packaged and placed in the tray, as shown in FIG. 2. The environment during packaging is preferably Argon or some inert gas. A chemical 18 is introduced into the container before the plate is inserted into position. The aluminum foil cover is then placed over the tray and the entire unit is wrapped in an inert gas environment. Vapors from the chemical coating will then over the storage time will form a very thin film on the sensitive surface to enhance wetability of subsequent photo-sensitive coatings. The plate is embedded by squeezing the plate edge into the contoured sidewalls so that it fits firmly on all four sides, thus preventing any relative movement between the plate edge and the tray itself. The squeezing action simultaneously contours the foil cover firmly holding the plate in the tray.

To manufacture the device, the tray material is in a flat planar sheet and the edges are trimmed. A stamping and bending process then shapes the inside of the tray and folds back the edges. The peripheral edges are then folded over underneath the tray body and contoured to the shape of the bottom.

Figure 5:
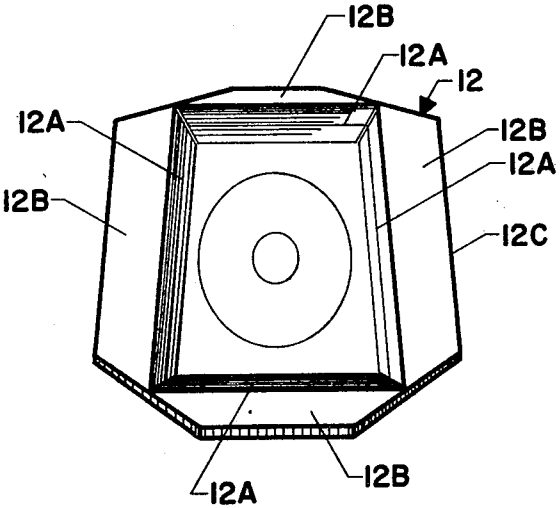
FIG. 5 shows a top plan view of the storage tray before the edges are folded under.

FIG. 5 shows the unitary tray 12 with the sides having extended panels 12B which have to be folded or curled downward and underneath and pressed flush against the bottom of the tray so as to be contoured when in position to add additional rigidity to the structure of the tray while preventing the cut edge portion 12C from exposure to the plate that is positioned within the tray. After the sides 12B have been turned under the device, the edges 12C will then lie beneath and away from the inside of the package. This prevents any particles from reaching the inside of the package that may occur from flaking along the edge perimeter 12C during packaging.

Figure 6:
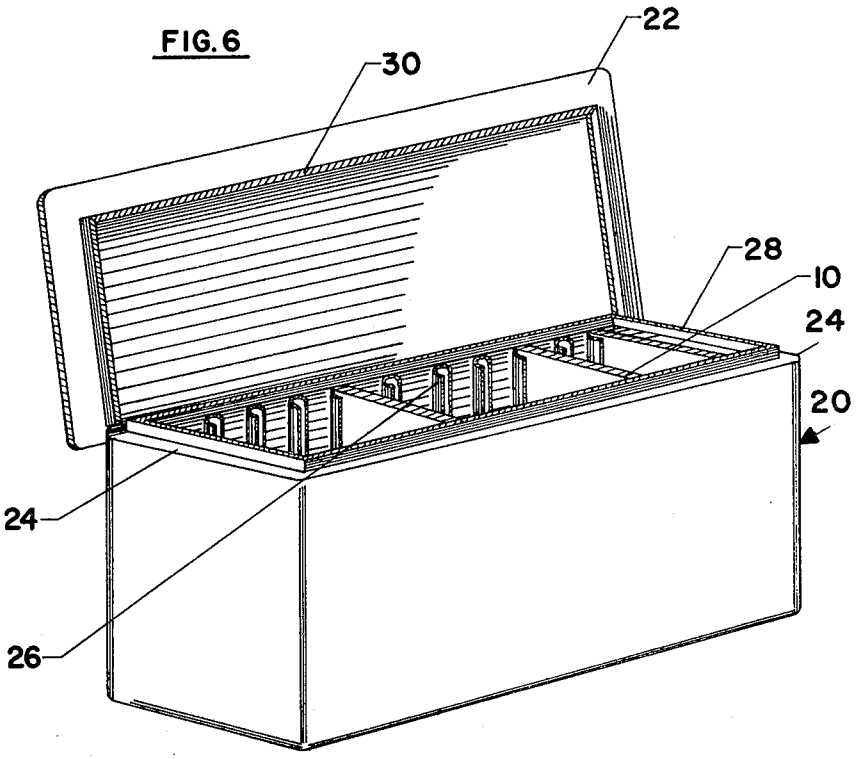
FIG. 6 shows a plurality of trays disposed in a sealable container in perspective.

Referring now to FIG. 6, a sealable rectangular container 20 is shown comprising rectangular body 24 having an openable lid 22, the lower container having a sealing ridge 28 which is received into a groove 30 in the lid of the container. In the container body 24, a plurality of grooved portions are disposed longitudinally, facing laterally symmetrically paired, the grooves 26 capable of receiving a plurality of individual package trays 10, having been previously described. The container may be plastic or any resilient material that is capable of hermetically sealing the interior portion of the container so that the interior environment may be maintained with an inert gas at a low atmospheric pressure. Each tray 10 is resiliently held in the container by the grooved portions to eliminate rattling or relative movement.

In operation, the individual plates are packaged in the individual trays as explained above. After each tray and plate has been packaged, it is placed within the container 24 which has additional cushioning pads on the bottom and top (not shown) and the entire unit is sealed for shipping.

One important feature of Applicant's packaging device and method is that the addition of the photo-resist chemical into each package tray allows for the shipping and storage time to be utilized for the vaporization of the chemical onto the plate to prepare the plate for its future utilization when the surface will receive a photoresist material which is spun to achieve a particular thickness with the additional chemical preparing the surface for this process. Thus, storage and shipping time is utilized to give sufficient time for the added chemical substance in the tray to vaporize. It is believed by the Applicant that evacuation and subjecting the tray to a low pressure atmospheric environment decreases the time necessary for the chemical substance to vaporize and coat the plate. The added chemical is quite important in the photo-resist process so that the surface is properly prepared and is sufficiently wet to allow for uniform coating by the spinning action when the photo-resist material is placed on the plate surface. This is to insure that the uniform pattern is properly etched on the final plate product. A typical chemical that may be added is Shipley Photo-resist AZ-135oh described in Solid State Technology, September, 1971. However, other photo-resist wetting ehancement substances could be employed.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A storage and shipping package for protecting the surface integrity of a sensitive plate stored therein comprising:

a relatively ductile body having a bottom portion and four side portions together forming a body cavity, said sides each having a continuous angularly disposed wall relative to said bottom portion;

a plate having a plurality of edge portions, said plate edge portions embedded in said body sidewalls whereby relative movement between said plate and said body sidewalls is prevented by the contoured fitting of said plate to said sidewalls;

a covering means disposed about said ductile body top portion and wrapped beneath the sidewall portions holding said plate in position; and means added within said package for enhancing the wetability of said plate surface for subsequent photo-sensitive coatings on said plate surface, said means coating said plate surface during storage and shipping.

2. A storage and shipping package for protecting the surface integrity of a sensitive plate used in a photographic process comprising:

a relatively ductile body including a lower portion and four side portions forming a body cavity for a sensitive plate, said body having a soft annealed aluminum body, each of said side portions having a continuous wall angularly disposed relative to said lower portion, each of said sides having formed edge flaps, a portion of said flaps folded under at least a major portion of the exterior of each of said side portions to provide an uncut edge along the top perimeter of said walls and to provide a double wall along at least the major portion of said side portions when the sensitive plate is sealed in the package, a covering means including cover edge flaps to enclose said body cavity when the sensitive plate is sealed in the package, said covering means having a soft annealed aluminum foil cover, and a deformable shelf disposed about the inside cavity of said ductile body and being deformed by the edge portions of said sensitive plate to aid in preventing relative motion between the sensitive plate and said side portions when said plate is stored within said package.

3. A storage and shipping package for protecting the surface integrity of a sensitive plate used in a photographic process comprising:

a relatively ductile body including a lower portion and four side portions forming a body cavity for a sensitive plate, each of said side portions having a continuous wall angularly disposed relative to said lower portion, each of said sides having formed edge flaps, a portion of said flaps folded under at least at a portion of the exterior of each of said side portions to provide an uncut edge along the top perimeter of said walls and to provide a double wall along at least the major portion of said side portions when the sensitive plate is sealed in the package, a metallic foil covering means including cover edge flaps coupled about said formed edge flaps to enclose said body cavity when the sensitive plate is sealed in the package, and, a shelf positioned and sized deformably engaging and retaining the lower edge portions of said sensitive plate within said side portions to aid in preventing relative motion between the sensitive plate and said side portions.

* * * * *